US006386574B1

(12) United States Patent
Tanaka

(10) Patent No.: US 6,386,574 B1
(45) **Date of Patent: *May 14, 2002**

(54) SNOWBOARD BOOT BINDING

(75) Inventor: Toshiyuki Tanaka, Sakai (JP)

(73) Assignee: Shimano, Inc., Osaka (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/419,003

(22) Filed: Oct. 13, 1999

(51) Int. Cl.[7] ..... A63C 9/10

(52) U.S. Cl. ..... 280/624; 280/14.21; 280/613; 280/631; 280/607

(58) Field of Search ..... 280/14.21, 613, 280/617, 14.22, 618, 623, 624, 631, 632, 607, 418, 420

(56) References Cited

U.S. PATENT DOCUMENTS

| | | | | | |
|---|---|---|---|---|---|
| 3,975,050 | A | * | 8/1976 | McKee | 248/418 X |
| RE33,544 | E | * | 2/1991 | Dennis | 280/14.2 X |
| 5,044,654 | A | * | 9/1991 | Meyer | 280/14.21 |
| 5,799,957 | A | | 9/1998 | Okajima et al. | 280/14.2 |
| 5,820,155 | A | * | 10/1998 | Brisco | 280/618 X |
| 5,855,390 | A | * | 1/1999 | Hassell | 280/14.2 |
| 5,906,388 | A | * | 5/1999 | Neiley | 280/613 |
| 5,909,894 | A | | 6/1999 | Meader et al. | 280/623 |
| 5,954,358 | A | * | 9/1999 | Bejean et al. | 280/14.2 |
| 5,971,420 | A | | 10/1999 | Okajima et al. | 280/613 |
| 6,315,318 | B1 | * | 11/2001 | Caron et al. | 280/607 |

FOREIGN PATENT DOCUMENTS

| | | | |
|---|---|---|---|
| DE | 3927144 | A1 | 6/1990 |
| FR | 2643277 | * | 12/1990 |
| JP | 11-42313 | | 2/1999 |
| WO | 97/04843 | | 2/1997 |
| WO | 97/16227 | | 5/1997 |

* cited by examiner

*Primary Examiner*—Brian L. Johnson
*Assistant Examiner*—Bryan Fischmann
(74) *Attorney, Agent, or Firm*—James A. Deland

(57) ABSTRACT

A support for a snowboard boot binding includes a support member having a first support surface extending on a first side of a support axis, wherein the first support surface is concave relative to the support axis, and wherein the first support surface extends less than 360° around the support axis. A second support surface is disposed on a second side of the support axis. The first and second support surfaces are configured such that they are capable of radially retaining a cleat engagement control shaft.

30 Claims, 4 Drawing Sheets

SNOWBOARD BOOT BINDING

BACKGROUND OF THE INVENTION

The present invention is directed to snowboard boot bindings and, more particularly, to a base plate for a snowboard boot binding that retains a latching shaft.

A typical snowboard boot binding used with cleated snowboard boots comprises a base plate, a front cleat engaging member for engaging the front of the cleat, a rear cleat engaging member for engaging the rear of the cleat, and a rear cleat control mechanism. The rear cleat control mechanism comprises a pair of spaced-apart shaft support members bolted to the top of the base plate, wherein each shaft support member has a circular hole in which a cleat engagement control shaft is rotatably mounted. The cleat engagement control shaft is axially retained to the pair of shaft support members by a C-clip installed in an annular groove at the end of the cleat engagement control shaft. The rear cleat is fixedly mounted to the cleat engagement control shaft between the pair of shaft support members so that the rear cleat may be rotated between engaged and disengaged positions by rotating the cleat engagement control shaft. A biasing spring also is installed around the cleat engagement control shaft and provides a biasing force for biasing the rear cleat to the engaged position.

One disadvantage of the conventional binding is that the cleat engagement control shaft is largely exposed to contamination by snow and other elements which can adversely affect the smooth rotation of the cleat engagement control shaft. Also, the cleat engagement control shaft is supported only by the pair of shaft support members which are closely spaced together. Thus, the shaft support members are subjected to strong forces which can damage or wear the shaft support members over time. Furthermore, the base plate usually must be made of metal so that such forces do not pull the shaft support members out of the base plate.

SUMMARY OF THE INVENTION

The present invention is directed to a base plate or support for a snowboard boot binding wherein the cleat engagement control shaft is largely protected from the elements, wherein the cleat engagement control shaft is supported at multiple locations by the support to distribute forces arising from the cleat engagement control shaft, and wherein the cleat engagement control shaft is supported by surfaces which extend less than 360° around the cleat engagement control shaft at any given axial location. Since the forces arising from the cleat engagement control shaft are distributed over multiple locations, the support may be made from a plastic or resin material rather than metal. Also, since the cleat engagement control shaft is supported by surfaces which extend less than 360° around the cleat engagement control shaft, any contaminants that do come between the cleat engagement control shaft and the supporting surfaces tend to be pushed away from the cleat engagement control shaft during normal operation of the cleat engagement control shaft.

In one embodiment of the present invention, a support for a snowboard boot binding includes a support member having a first support surface extending on a first side of a support axis, wherein the first support surface is concave relative to the support axis, and wherein the first support surface extends less than 360 degrees around the support axis. A second support surface is disposed on a second side of the support axis. The first and second support surfaces are configured such that they are capable of radially retaining a cleat engagement control shaft. In a more specific embodiment, the first support surface and the second support surface together form a bounded opening when viewed in the direction of the support axis. If desired, the first support surface may have a U-shape and the second support surface may be flat, wherein the second support surface is located opposite the bottom of the "U." Such surfaces can alternate with each other along the path of the cleat engagement control shaft.

DETAILED DESCRIPTION OF THE EMBODIMENTS

Figure 1:
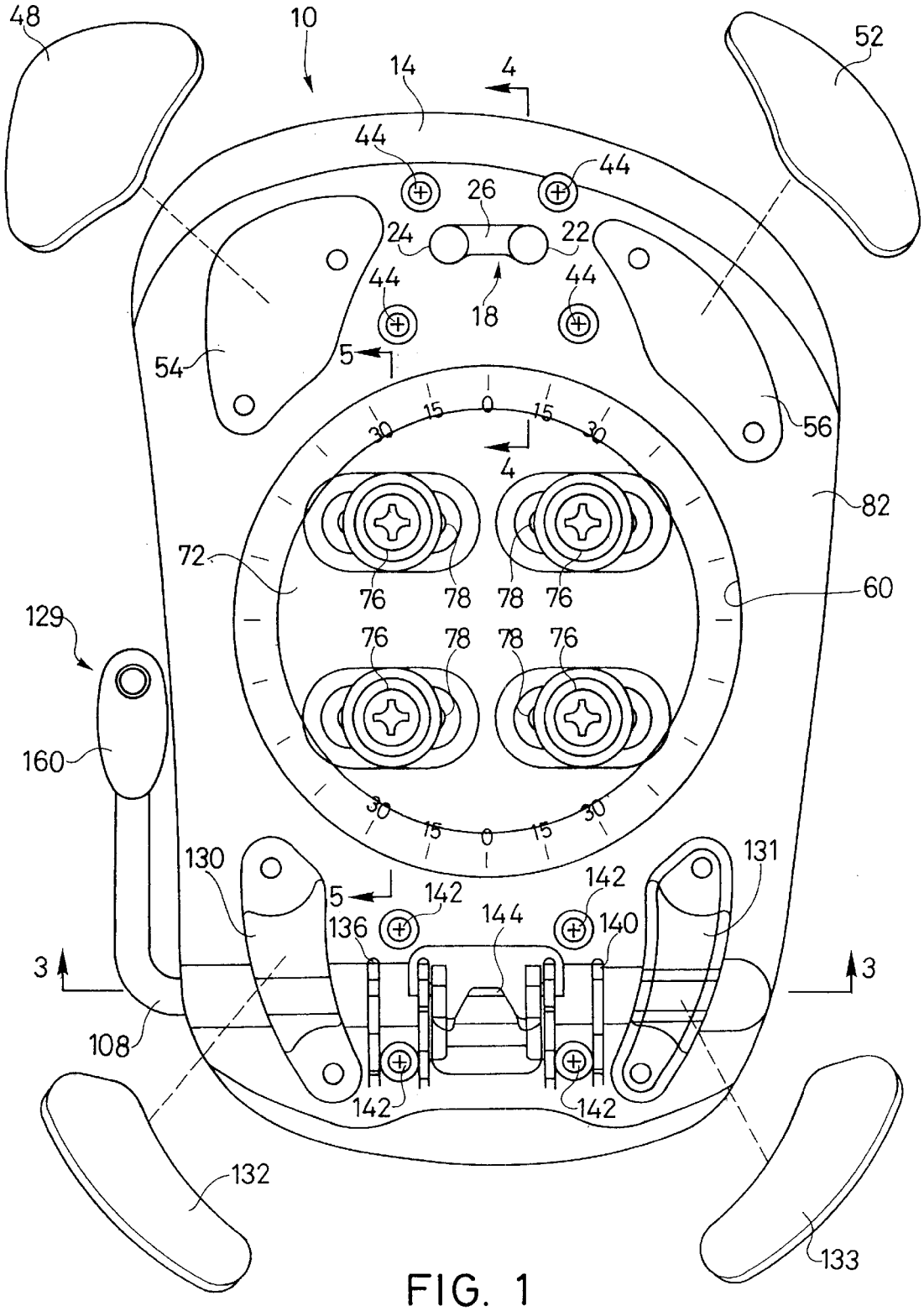
FIG. 1 is a top view of a particular embodiment of a snowboard boot binding according to the present invention.
Figure 2:
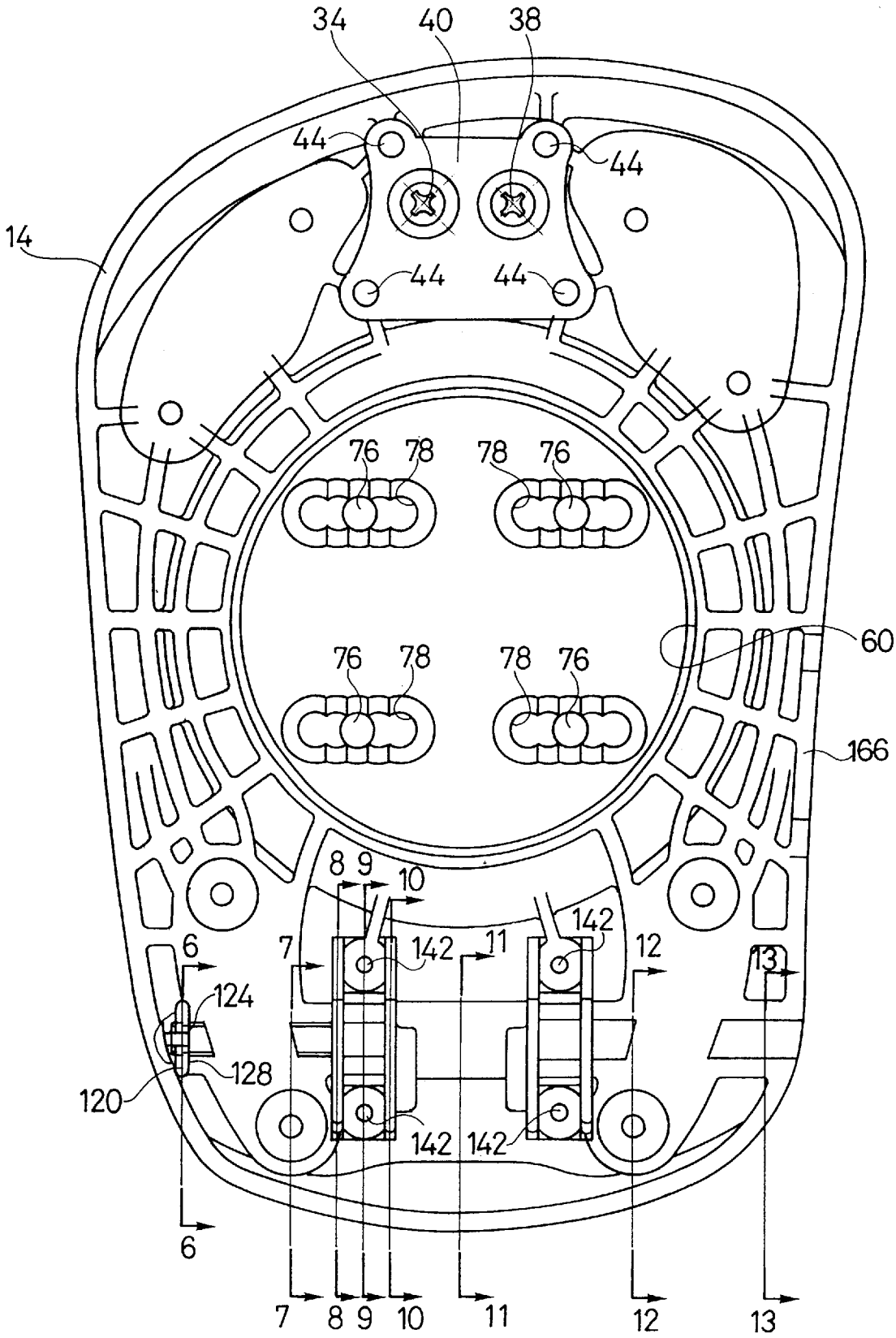
FIG. 2 is a bottom view of the snowboard boot binding shown in FIG. 1.

FIG. 1 is a top view of a particular embodiment of a snowboard boot binding 10 according to the present invention, and FIG. 2 is a bottom view of snowboard boot binding 10. In this embodiment, binding 10 includes a one-piece base member or support plate (member) 14 made of metal, plastic, resin or some other material. While support plate 14 could be made from many materials and still enjoy the advantages of the present invention, forming support plate 14 from a resin, plastic or some other kind of molded material makes fabrication easier, thus lowering the cost of the binding as a whole.

Figure 4:
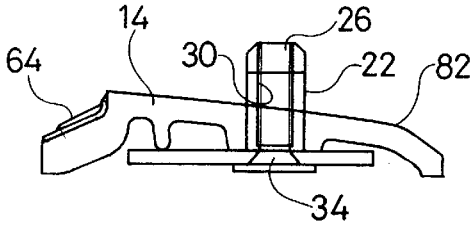
FIG. 4 is a view taken along line 4—4 in FIG. 1.

A front (first) cleat engaging member 18 is disposed at the front of base plate 14 for engaging the front of a cleat (not shown) mounted to the bottom of the snowboard boot. Front cleat engaging member 18 comprises vertically mounted support posts 22 and 24 and a transverse cleat engaging bar 26. Support posts 22 and 24 have threaded openings 30 (only threaded opening 30 for support post 22 is shown in FIG. 4) for engaging mounting screws 34 and 38 that mount front cleat engaging member 18 to support plate 14. A force distributing plate 40 is used to distribute the forces exerted by mounting screws 34 and 38, and this parcing distributing plate 40 may be further mounted to the bottom of support plate 14 by screws 44. Plastic or rubber pads 48 and 52 may be mounted in recesses 54 and 56, respectively, formed by the molding process for a more aesthetic appearance and to prevent accumulation of snow or water.

Figure 5:
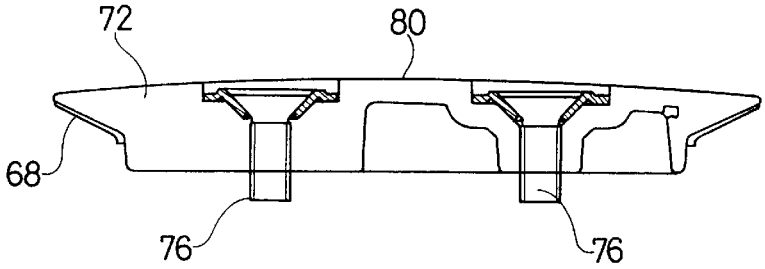
FIG. 5 is a view taken along line 5—5 in FIG. 1.
Figure 6:
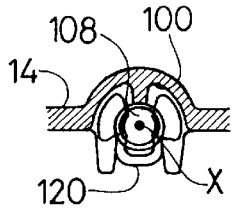
FIG. 6 is a view taken along line 6—6 in FIG. 2.
Figure 7:
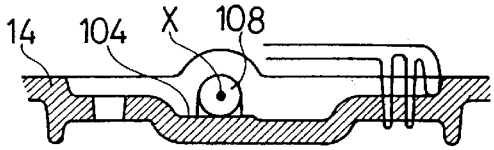
FIG. 7 is a view taken along line 7—7 in FIG. 2.
Figure 8:
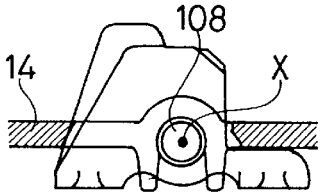
FIG. 8 is a view taken along line 8—8 in FIG. 2.
Figure 9:
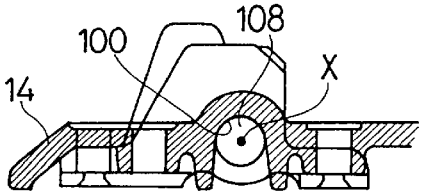
FIG. 9 is a view taken along line 9—9 in FIG. 2.
Figure 10:
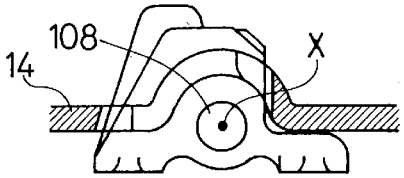
FIG. 10 is a view taken along line 10—10 in FIG. 2.
Figure 11:
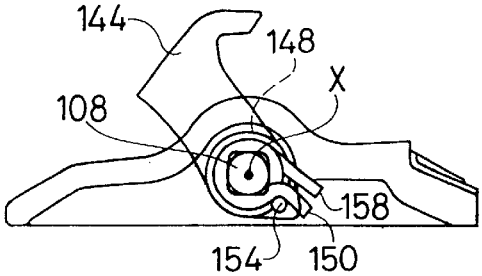
FIG. 11 is a view taken along line 11—11 in FIG. 2.
Figure 12:
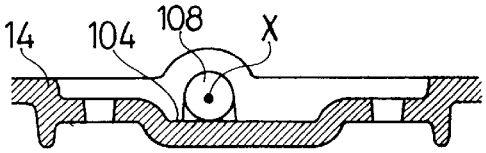
FIG. 12 is a view taken along line 12—12 in FIG. 2.
Figure 13:
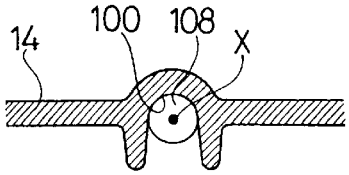
FIG. 13 is a view taken along line 13—13 in FIG. 2.

Support plate 14 has a centrally disposed circular turntable mounting hole 60 with a serrated border 64 (FIG. 4) for engaging corresponding serrations 68 (FIG. 5) in a circular turntable 72. As is well known, turntable 72 is mounted to the snowboard (not shown) through mounting bolts 76 that extend through oval openings 78 for fixing a rotational position of support plate 14 on the snowboard. The rotational position of support plate 14 may be adjusted by loosening bolts 76, disengaging serrations 68 in turntable 72 from serrations 64 in support plate 14, rotating support plate 14 relative to turntable 72 to the desired position, re-engaging serrations 68 with serrations 64 to fix the rotational position of support plate 14, and tightening bolts 76. As shown in FIG. 5, an upper surface 80 of turntable 72 has a curved shape to increase rigidity of the turntable, to make it easier to manipulate turntable 72 with the hand, and to provide for a more aesthetic appearance. In this embodiment, the radius of curvature of the curved upper surface 80 is substantially constant to give upper surface 80 the shape of a truncated sphere. An upper surface 82 of support plate 14 has a similarly curved shape.

The structure of the rear portion of support plate 14 may be understood by referring to FIGS. 1–3 and 6–13. As shown in those Figures, support plate 14 includes a plurality of a first support surfaces 100 (FIGS. 6, 9 and 13) and a plurality of second support surfaces 104 (FIGS. 7 and 12) for radially retaining a cleat engagement control shaft 108. Support plate 14 and cleat engagement control shaft 108 together may be considered a support apparatus. Each first support surface 100 extends on a first side of a support axis (X), is concave relative to the support axis (X), and extends less than 360° around the support axis. In this embodiment, each first support surface has a generally U-shape with a substantially constant radius of curvature at the curved portion, and each second support surface 104 is substantially flat so that the first support surfaces 100 and second support surfaces 104 form a bounded, substantially circular opening when viewed in the direction of the support axis (X), but other shapes are possible. Preferably, each first support surface 100 curves for at least 20°, more preferably 45°, and even more preferably at least 90°. However, these values are not absolutely necessary, and the plurality of first supports surfaces 100 need not have the same extent of curvature. For example, a first support surface 100 may have only a few degrees of curvature as long as it cooperates with the other support surfaces to radially support cleat engagement control shaft 108 or distribute the forces from cleat engagement support shaft 108. For the same reason, the plurality of first support surfaces 100 and second support surfaces 104 need not form a bounded opening when viewed in the direction of the support axis (X). A first support surface 100 need not have a constant radius of curvature and need not form a smooth curve. Other shapes are certainly possible, such as square, polygonal, irregular, etc. Also, the second support surfaces 104 need not be flat.

In this embodiment, the first support surfaces 100 and second support surfaces 104 are disposed along the support axis (X) in a generally alternating manner to provide a more even distribution of forces as well as to form a more rigid support for cleat engagement control shaft 108. Of course, two or more first support surfaces 100 may be disposed in a row, or two or more second support surfaces 104 may be disposed in a row if desired for some applications. In any event, the support surface next to a pair of a first support surface 100 and/or a second support surface 104 can be considered a third support surface.

Figure 3:
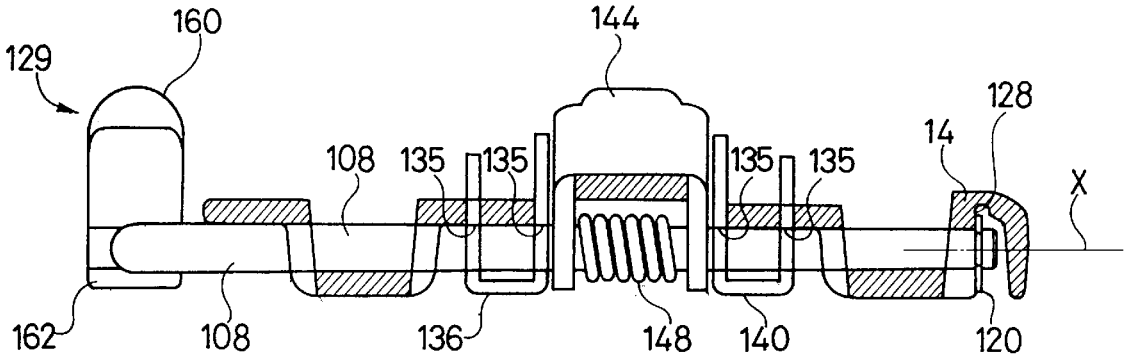
FIG. 3 is a view taken along line 3—3 in FIG. 1.

As shown more specifically in FIG. 3, cleat engagement control shaft 108 extends along the support axis X through the generally undulating arrangement of the first and second support surfaces 100 and 104. Cleat engagement control shaft 108 is axially retained in support plate 14 by a C-clip 120 that fits within an annular groove 124 in the end of cleat engagement support shaft 108 and abuts against a side surface 128 of support plate 14. Cleat engagement control shaft 108 bends approximately 90° and extends forwardly terminating at a control handle 129. Because of the configuration of first and second support surfaces 100 and 104, recesses 130 and 131 are formed in the rear of support plate 14. Accordingly, pads 132 and 133 similar to pads 48 and 52 may be placed in recess 130 and 131, respectively, to protect the exposed portion of cleat engagement control shaft 108.

Cleat engagement control shaft 108 also passes through openings 135 in a pair of U-shaped metal support brackets 136 and 140 mounted to support plate 14 through bolts 142. A claw-shaped cleat engaging member 144 is nonrotatably mounted to cleat engagement control shaft 108 for integral rotation therewith, wherein cleat engaging member 144 is disposed between support brackets 136 and 140. A coiled biasing spring 148 disposed around cleat engagement control shaft 108 has a first end 150 (FIG. 11) abutting against a spring retaining abutment 154 on cleat engaging member 144 and a second end 158 abutting against support plate 14. Spring 148 biases cleat engaging member clockwise in FIG. 11 to the cleat engaging position. Control handle 129 is pivotably mounted to cleat engagement control shaft 108 so that knob 160 may be rotated to cause a lock plate 162 to engage a bottom lock surface 166 (FIG. 2) of support plate 14 to prevent cleat engagement control shaft 108 from inadvertently rotating and moving cleat engaging member 144 to the disengaging position.

While the above is a description of various embodiments of the present invention, further modifications may be employed without departing from the spirit and scope of the present invention. For example, the size, shape, location or orientation of the various components may be changed as desired. The functions of one element may be performed by two, and vice versa. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the scope of the invention should not be limited by the specific structures disclosed or the apparent initial focus on a particular structure or feature.

What is claimed is:

1. A support apparatus for a snowboard boot binding comprising:

a one-piece support member having a first support surface extending on a first side of a support axis and a second support surface disposed on a second side of the support axis, wherein the support axis extends the full distance between opposite side edges of the support member and terminates at the opposite side edges of the support member;

wherein the first support surface is concave relative to the support axis;

wherein the first support surface extends less than 360° around the support axis; and a shaft extending along the support axis and through a midpoint of the support axis, wherein the shaft is retained to the support member in all radial directions relative to the support axis by the first support surface and the second support surface.

2. The support apparatus according to claim 1 wherein the first support surface and the second support surface together form a bounded opening when viewed in the direction of the support axis.

3. The support apparatus according to claim 1 wherein the second support surface is substantially flat.

4. The support apparatus according to claim 1 wherein a straight phantom line perpendicular to the support axis intersects the first support surface and the second support surface.

5. The support apparatus according to claim 1 wherein a portion of the first support surface curves with a substantially constant radius of curvature.

6. The support apparatus according to claim 5 wherein the first support surface curves with a substantially constant radius of curvature for at least 20°.

7. The support apparatus according to claim 6 wherein the first support surface curves with a substantially constant radius of curvature for at least 45°.

8. The support apparatus according to claim 7 wherein the first support surface curves with a substantially constant radius of curvature for at least 90°.

9. The support apparatus according to claim 1 wherein the first support surface has a U-shape.

10. The support apparatus according to claim 9 wherein the second support surface is substantially flat.

11. The support apparatus according to claim 1 wherein the support member has a third support surface extending on the first side of a support axis.

12. The support apparatus according to claim 11 wherein the first support surface, the second support surface and the third support surface together form a bounded opening when viewed in the direction of the support axis.

13. The support apparatus according to claim 11 wherein the third support surface is concave relative to the support axis, and wherein the third support surface extends less than 360° around the support axis.

14. The support apparatus according to claim 13 wherein the second support surface is disposed between the first support surface and the third support surface in the direction of the support axis.

15. The support apparatus according to claim 14 wherein the second support surface is substantially flat.

16. The support apparatus according to claim 11 wherein the first support surface is disposed between the second support surface and the third support surface in the direction of the support axis.

17. The support apparatus according to claim 16 wherein the second support surface is substantially flat, and wherein the third support surface is substantially flat.

18. The support apparatus according to claim 1 wherein the support member has a substantially plate shape.

19. The support apparatus according to claim 18 wherein the support member has an upper support member surface that curves from front to back.

20. The support apparatus according to claim 18 wherein the support member includes a turntable opening.

21. The support apparatus according to claim 20 wherein the turntable opening has a circular shape.

22. The support apparatus according to claim 20 further comprising a turntable disposed in the turntable opening.

23. The support apparatus according to claim 22 wherein the turntable has a curved upper turntable surface.

24. The support apparatus according to claim 23 wherein the upper turntable surface has a substantially constant radius of curvature.

25. The support apparatus according to claim 1 wherein the shaft is rotatably supported by the first support surface and the second support surface.

26. A snowboard boot binding comprising:

a one-piece support member, wherein the support member includes:

a first support surface extending on a first side of a support axis, wherein the support axis extends the full distance between opposite side edges of the support member and terminates at the opposite side edges of the support member;

wherein the first support surface is concave relative to the support axis;

wherein the first support surface extends less than 360° around the support axis; and a second support surface disposed on a second side of the support axis;

a first cleat engaging member disposed on the support member;

a shaft extending along the support axis and through a midpoint of the support axis, wherein the shaft is retained to the support member in all radial directions relative to the support axis by the first support surface and the second support surface; and a second cleat engaging member disposed on the shaft.

27. A support member for a snowboard boot binding comprising:

a one-piece support member having a first support surface extending on a first side of a support axis and a second support surface disposed on a second side of the support axis, wherein the support axis extends the full distance between opposite side edges of the support member and terminates at the opposite side edges of the support member;

wherein the first support surface is concave relative to the support axis;

wherein the first support surface extends less than 360° around the support axis;

wherein the first support surface and the second support surface together form a bounded opening extending more than 180° when viewed in the direction of the support axis; and wherein a space defined by the bounded opening extends through a midpoint of the support axis.

28. A support member for a snowboard boot binding comprising:

a one-piece support member having a first support surface extending on a first side of a support axis and a second support surface disposed on a second side of the support axis, wherein the support axis extends the full distance between opposite side edges of the support member and terminates at the opposite side edges of the support member;

wherein the first support surface is concave relative to the support axis;

wherein the first support surface extends less than 360° around the support axis;

wherein the first support surface and the second support surface together form a bounded opening when viewed in the direction of the support axis;

wherein a space defined by the bounded opening extends through a midpoint of the support axis; and wherein the bounded opening has a shape such that, when a shaft having a radius of curvature substantially equal to the concave first surface is inserted into the bounded opening, the shaft is prevented by the bounded opening from exiting the first support surface and the second support surface in any radial direction.

29. A support member for a snowboard boot binding comprising:

a one-piece support member having a first support surface extending on a first side of a horizontal, laterally extending support axis and a second support surface disposed on a second side of the support axis, wherein the support axis extends the full distance between opposite lateral edges of the support member and terminates at the opposite lateral edges of the support member;

wherein the first support surface is concave on a side facing the support axis and partially encircles the support axis;

wherein the first support surface extends less than 360° around the support axis;

wherein a space defined by the first support surface and the second support surface when viewed in a direction of the support axis extends through a midpoint of the support axis; and wherein at least one of the first support surface and the second support surface is disposed at a bottom side of the support member and faces downwardly.

30. A support apparatus for a snowboard boot binding comprising:

a one-piece support member having a first support surface extending on a first side of a support axis and a second support surface disposed on a second side of the support axis;

wherein the first support surface is concave relative to the support axis;

wherein the first support surface extends less than 360° around the support axis; and a shaft extending a full distance between opposite side edges of the support member, wherein the shaft is retained to the support member in all radial directions relative to the support axis by the first support surface and the second support surface.

* * * * *